US009046870B2

(12) United States Patent
Sumikura et al.

(10) Patent No.: US 9,046,870 B2
(45) Date of Patent: Jun. 2, 2015

(54) IMAGE FORMING APPARATUS

(71) Applicant: KYOCERA Document Solutions Inc., Osaka (JP)

(72) Inventors: Noriaki Sumikura, Osaka (JP); Katsuhiro Yoshiuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/255,797

(22) Filed: Apr. 17, 2014

(65) Prior Publication Data

US 2014/0314448 A1 Oct. 23, 2014

(30) Foreign Application Priority Data

Apr. 19, 2013 (JP) ..... 2013-088484

(51) Int. Cl.
*G03G 15/04* (2006.01)
*G03G 21/16* (2006.01)

(52) U.S. Cl.
CPC .... *G03G 21/1676* (2013.01); *G03G 2215/0634* (2013.01); *G03G 21/1647* (2013.01); *G03G 2221/1654* (2013.01)

(58) Field of Classification Search
USPC ..... 399/119
See application file for complete search history.

(56) References Cited

U.S. PATENT DOCUMENTS 5,410,387 A * 4/1995 Yamada ..... 355/200
7,224,914 B2 * 5/2007 Ushiroji et al. ..... 399/27

FOREIGN PATENT DOCUMENTS

JP 06-250512 A 9/1994
JP 2004-264519 A 9/2004

* cited by examiner

*Primary Examiner* — Clayton E Laballe
*Assistant Examiner* — Warren K Fenwick
(74) *Attorney, Agent, or Firm* — Knobbe, Martens, Olson & Bear LLP

(57) ABSTRACT

A copier includes a developing unit, a toner container, a first movable unit, and a second movable unit. The first movable unit carries the developing unit and is movable between a close position where a developing roller of the developing unit is located close to a photosensitive drum and a distant position where the developing roller is located away from the photosensitive drum. The second movable unit carries the toner container and is configured to drag the first movable unit from the close position to the distant position. The copier is configured so that while the second movable unit is located at a standby position for the drag, a clearance is formed between the first and second movable units to avoid physical contact between the first and second movable units.

6 Claims, 11 Drawing Sheets

IMAGE FORMING APPARATUS

INCORPORATION BY REFERENCE

This application claims priority to Japanese Patent Application No. 2013-088484 filed on Apr. 19, 2013, the entire contents of which are incorporated by reference herein.

BACKGROUND

The present disclosure relates to image forming apparatuses.

Known image forming apparatuses include those configured so that an electrostatic latent image is formed on the peripheral surface of a photosensitive drum, the formed electrostatic latent image is developed by supply of toner from a developing roller, and the toner image is transferred to a given sheet material. In such an image forming apparatus, generally, a photosensitive drum, a developing roller, and their surrounding elements are integrated into a single or plurality of units and designed to be capable of being pulled out of the apparatus body unit by unit, resulting in improved efficiency of maintenance work and assembly work.

Meanwhile, a developing unit including a developing roller is generally constructed with the developing roller facing a photosensitive drum through gap rollers between them, is urged toward the photosensitive drum by a pressure spring to press the gap rollers against the photosensitive drum, and thus maintains a constant distance between the developing roller and the photosensitive drum. Therefore, in pulling the developing unit out of the apparatus body, a separating mechanism is necessary which can completely separate the developing roller from the photosensitive drum.

For example, the following developer supporting device is known as such a separating mechanism which can separate the developing unit from the photosensitive drum. The developer supporting device is configured to support on a fixed frame a carriage body, which is normally held at a position to install a developer by an urging device, movably in a direction perpendicular to the axis of the photosensitive drum (horizontal direction). With the use of the developer supporting device, when the carriage body is moved against the urge of the urging device, the developing roller can be separated completely from the photosensitive drum and thus the developing unit can be pulled out of the apparatus body.

SUMMARY

A technique improved over the aforementioned technique is proposed as one aspect of the present disclosure.

An image forming apparatus according to one aspect of the present disclosure includes a developing unit, a toner container, a first movable unit, and a second movable unit.

The developing unit includes a developing roller operable to develop a toner image on a peripheral surface of a photosensitive drum.

The toner container is configured to supply toner to the developing unit.

The first movable unit carries the developing unit and is movable between a close position where the developing roller is located close to the photosensitive drum and a distant position where the developing roller is located away from the photosensitive drum.

The second movable unit carries the toner container and is configured to drag the first movable unit from the close position to the distant position.

Furthermore, in the image forming apparatus, while the second movable unit is located at a standby position for the drag, a clearance is formed between the first and second movable units to avoid physical contact between the first and second movable units.

DETAILED DESCRIPTION

A description will be given below of an image forming apparatus according to one embodiment of the present disclosure with reference to the drawings. Hereinafter, an XYZ orthogonal coordinate system may be set and the relative positions among elements may be described with reference to the XYZ orthogonal coordinate system. A given direction in the horizontal plane is defined as an x-axis direction, the direction orthogonal to the x-axis direction in the horizontal plane is defined as a y-axis direction, and the direction orthogonal to both the x-axis and y-axis directions (i.e., the vertical direction) is defined as a z-axis direction.

(Schematic Structure of Image Forming Apparatus)

Figure 1:
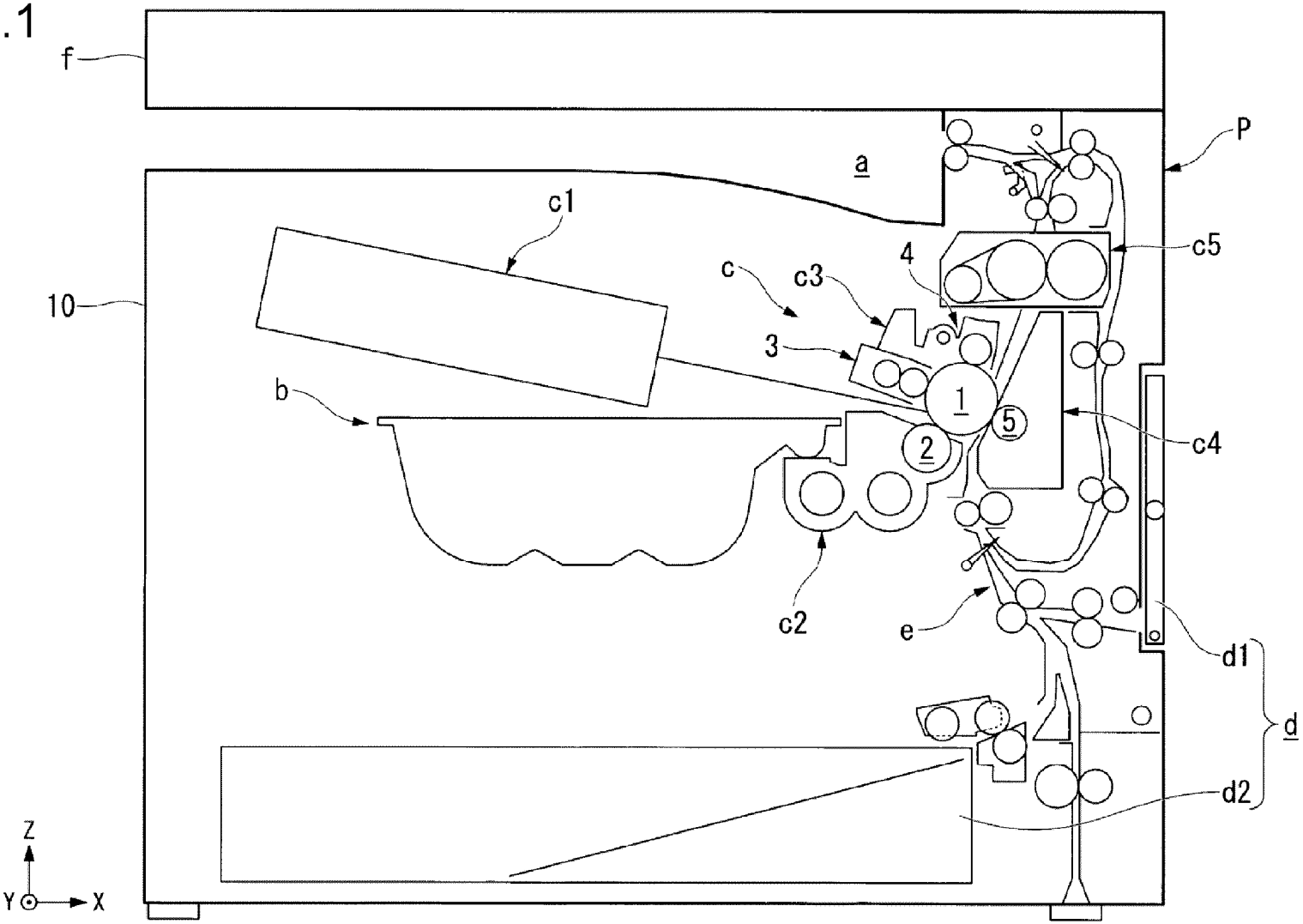
FIG. 1 is a schematic structural view of a copier in one embodiment of the present disclosure.

FIG. 1 is a schematic structural view of a copier P in one embodiment of the present disclosure.

The copier (image forming apparatus) P includes an output section a, a toner container b, an image forming section c, and a paper feed section d. The copier P is provided with a conveyance section e extending from the paper feed section d located in a lower portion to the output section a located in an upper portion. The copier P is further provided with a scanner section f which is located above the output section a and configured to read an original document.

The output section a is configured so that a sheet of paper (sheet material) with a given image formed thereon is output thereto via the conveyance section e. The bottom surface of the output section a has an inclination designed so that a plurality of output paper sheets can be piled up thereon with their one ends aligned.

The toner container b is configured to contain, for example, black toner (BK) and be capable of supply the toner to a developing unit c2 of the image forming section c.

The image forming section c includes a laser scanning unit c1, the developing unit c2, a drum unit c3, a transfer unit c4, and a fixing unit c5.

The laser scanning unit c1 includes, like a known laser scanning unit, a light beam generator (not shown) capable of generating laser light, a polygon mirror (not shown) operable to scan a light beam emitted from the light beam generator, and an fθ lens (not shown) operable to form, from the light beam scanned by the polygon mirror, an image on a photosensitive drum (image carrier) 1 to be described later.

The developing unit c2 is configured to supply the toner to the photosensitive drum 1 to develop an electrostatic latent image formed on the peripheral surface of the photosensitive drum 1 and includes a developing roller 2 disposed facing the peripheral surface of the photosensitive drum 1 in a radial direction thereof.

The drum unit c3 includes the photosensitive drum 1 on the peripheral surface of which an electrostatic latent image can be formed using the laser scanning unit c1 and a toner image can be then formed of the toner supplied from the toner container b to the developing unit c2.

Disposed around and facing the photosensitive drum 1 are a charger 3 configured to charge the peripheral surface of the photosensitive drum 1 with electricity, a cleaner 4 configured to clean the residual toner on the peripheral surface of the photosensitive drum 1 subjected to a transfer process, and other surrounding elements. The charger 3, the cleaner 4, and the other surrounding elements in this embodiment are integrated as a removable drum unit c3 together with the photosensitive drum 1.

The transfer unit c4 includes a transfer roller 5 disposed facing the peripheral surface of the photosensitive drum 1 in a radial direction thereof. The transfer roller 5 is provided to press against the photosensitive drum 1.

Therefore, when the photosensitive drum 1 is driven into rotation, the transfer roller 5 can accordingly rotate. Furthermore, when a given sheet material, for example, a paper sheet, is conveyed to the transfer roller 5 via the conveyance section e, the transfer roller 5 can be rotated with the paper sheet between the transfer roller 5 and the photosensitive drum 1 and convey the paper sheet toward the fixing unit c5.

The fixing unit c5 is provided in a portion of the conveyance section e located downstream of the transfer unit c4 and includes a pair of rollers disposed to be capable of nipping the paper sheet conveyed through the conveyance section e. Furthermore, the fixing unit c5 is configured so that the pair of rollers can apply pressure and heat to a toner image transferred to the paper sheet by the transfer unit c4 to fix the toner image on the paper sheet.

The paper feed section d includes: a paper feed tray d1 provided to be openable and closable relative to an apparatus body 10; and a paper feed cassette d2 provided to be capable of being pulled out of the apparatus body 10. The paper feed section d is configured to be capable of supplying paper sheets one by one from the paper feed tray d1 or the paper feed cassette d2 to the conveyance section e.

The conveyance section e is provided to extend from the paper feed section d located in the lower portion to the output section a located in the upper portion and includes a plurality of conveyance rollers and a plurality of guide plates. Furthermore, the conveyance section e is configured to be capable of conveying paper sheets supplied from the paper feed section d sheet by sheet toward the output section a.

In the copier P having the above configuration, laser light corresponding to image data is emitted from the laser scanning unit c1 to the photosensitive drum 1 to form an electrostatic latent image on the photosensitive drum 1 and a toner image is developed from the electrostatic latent image by the toner supplied. Then, the toner image carried on the photosensitive drum 1 is transferred to a paper sheet by the transfer unit c4 and pressure and heat are then applied to the toner image on the paper sheet by the fixing unit c5, so that the toner image is fixed on the paper sheet. Finally, the paper sheet with the image printed thereon is output to the output section a.

(Structures of Apparatus Body and Units)

Figure 2:
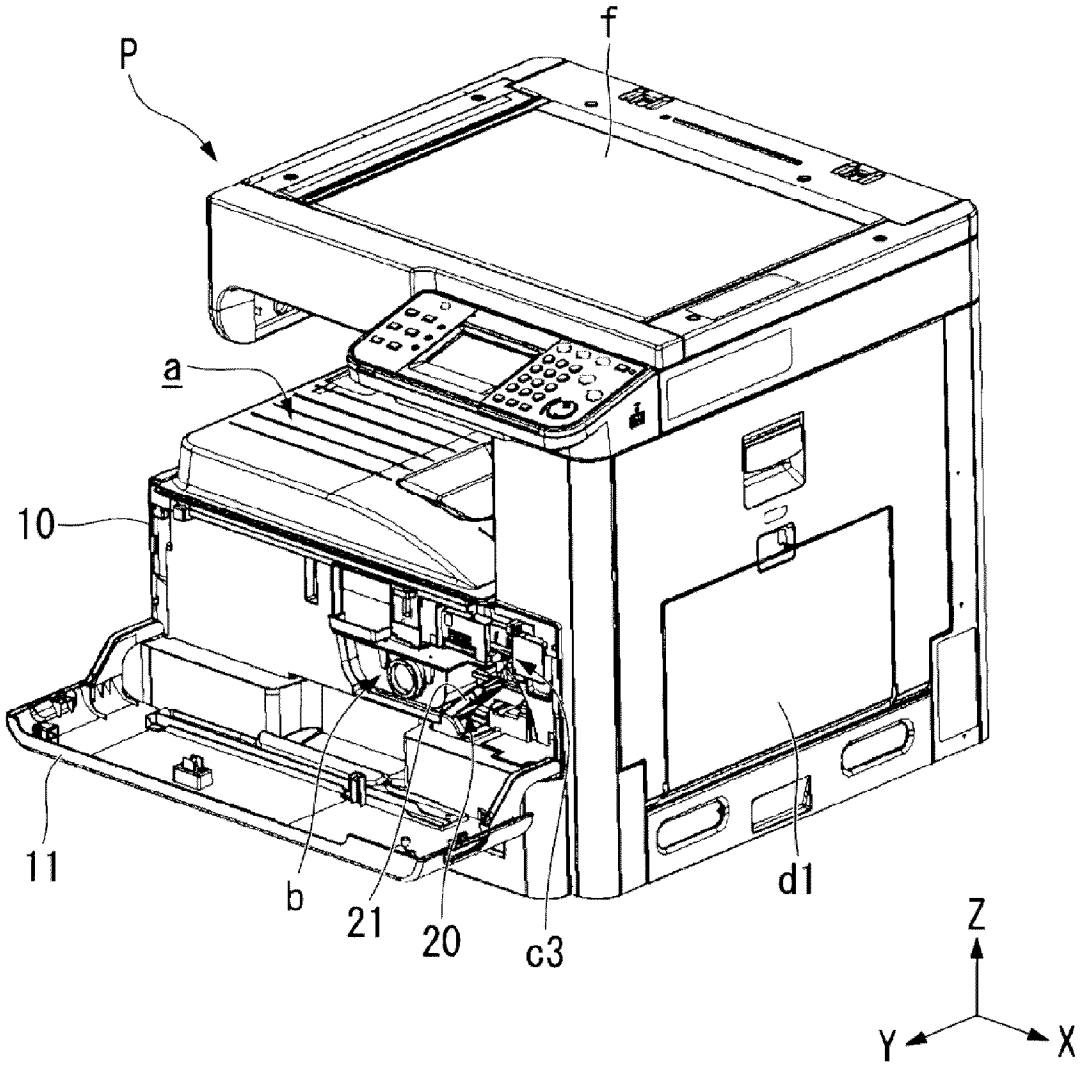
FIG. 2 is a perspective view showing the appearance of an apparatus body in the one embodiment of the present disclosure.
Figure 3:
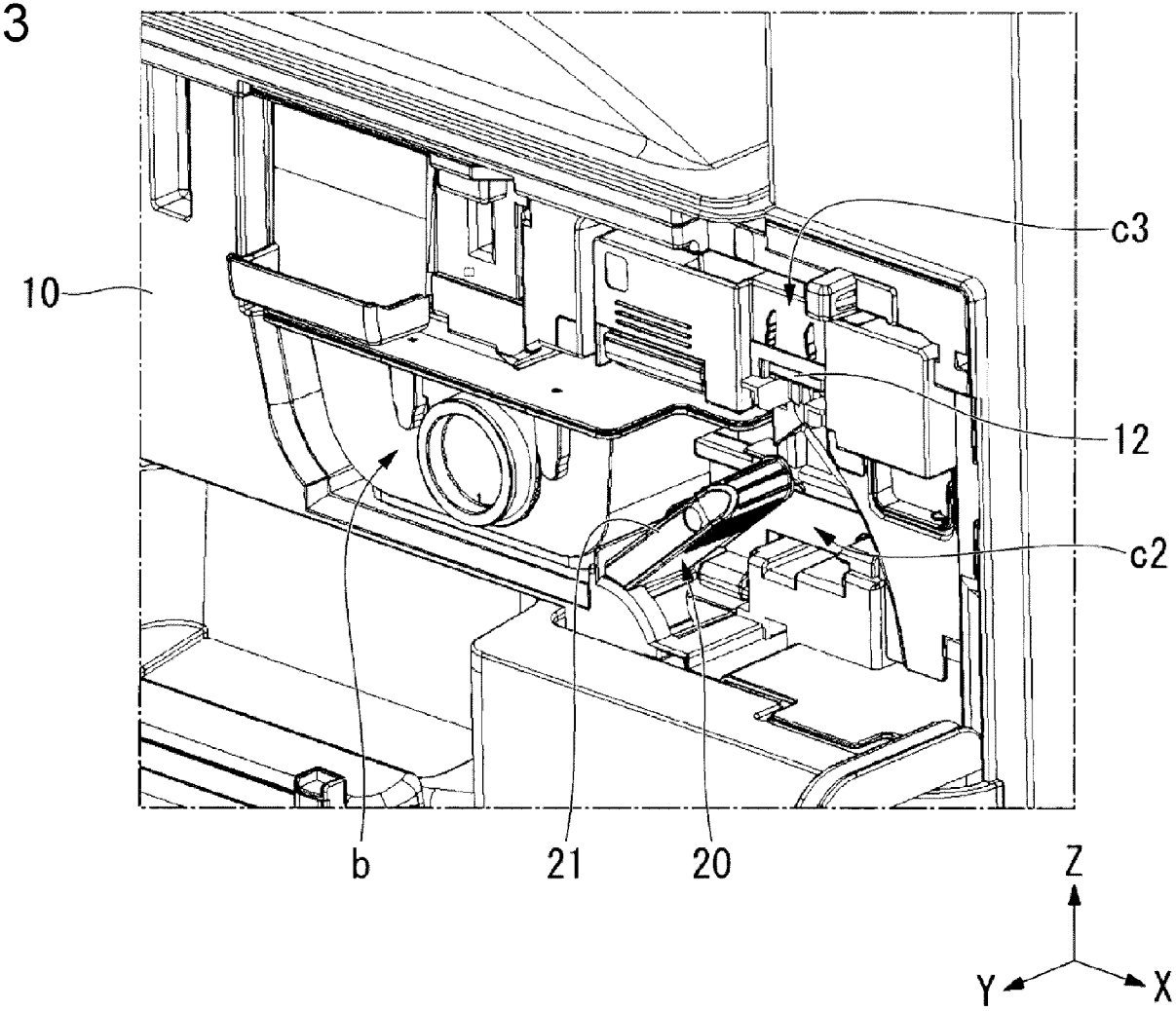
FIG. 3 is an enlarged perspective view showing a relevant portion in FIG. 2.

FIG. 2 is a perspective view showing the appearance of the apparatus body 10 in the one embodiment of the present disclosure. FIG. 3 is an enlarged perspective view showing a relevant portion in FIG. 2.

As shown in FIG. 2, a cover 11 is provided on the near side (+y side) of the apparatus body 10 so as to be openable and closable relative to the apparatus body 10. When the cover 11 is opened, respective portions of the developing unit c2, the drum unit c3, and the toner container b are exposed to the outside as shown in FIG. 3.

The drum unit c3 is provided with a handle 12. Furthermore, each of the developing unit c2 and the drum unit c3 is configured to be capable of being pulled out of the apparatus body 10 toward the near side along an unshown guide. Specifically, the copier P is configured so that the photosensitive drum 1 and some of its surrounding elements can be removed together from the apparatus body 10 by pulling out the drum unit c3 toward the near side and the developing roller 2 and some of its surrounding elements can be removed together from the apparatus body 10 by pulling out the developing unit c2 toward the near side.

Since as shown in FIG. 1 the photosensitive drum 1 and the developing roller 2 are disposed close to each other, the developing roller 2 needs to be located away from the photosensitive drum 1 in pulling out the developing unit c2 and/or the drum unit c3. The copier P of this embodiment is configured to allow the worker to separate the developing unit c2 from or bring it back close to the photosensitive drum 1 in conjunction with the operation of the operating lever 21 of the operating device 20.

Figure 4:
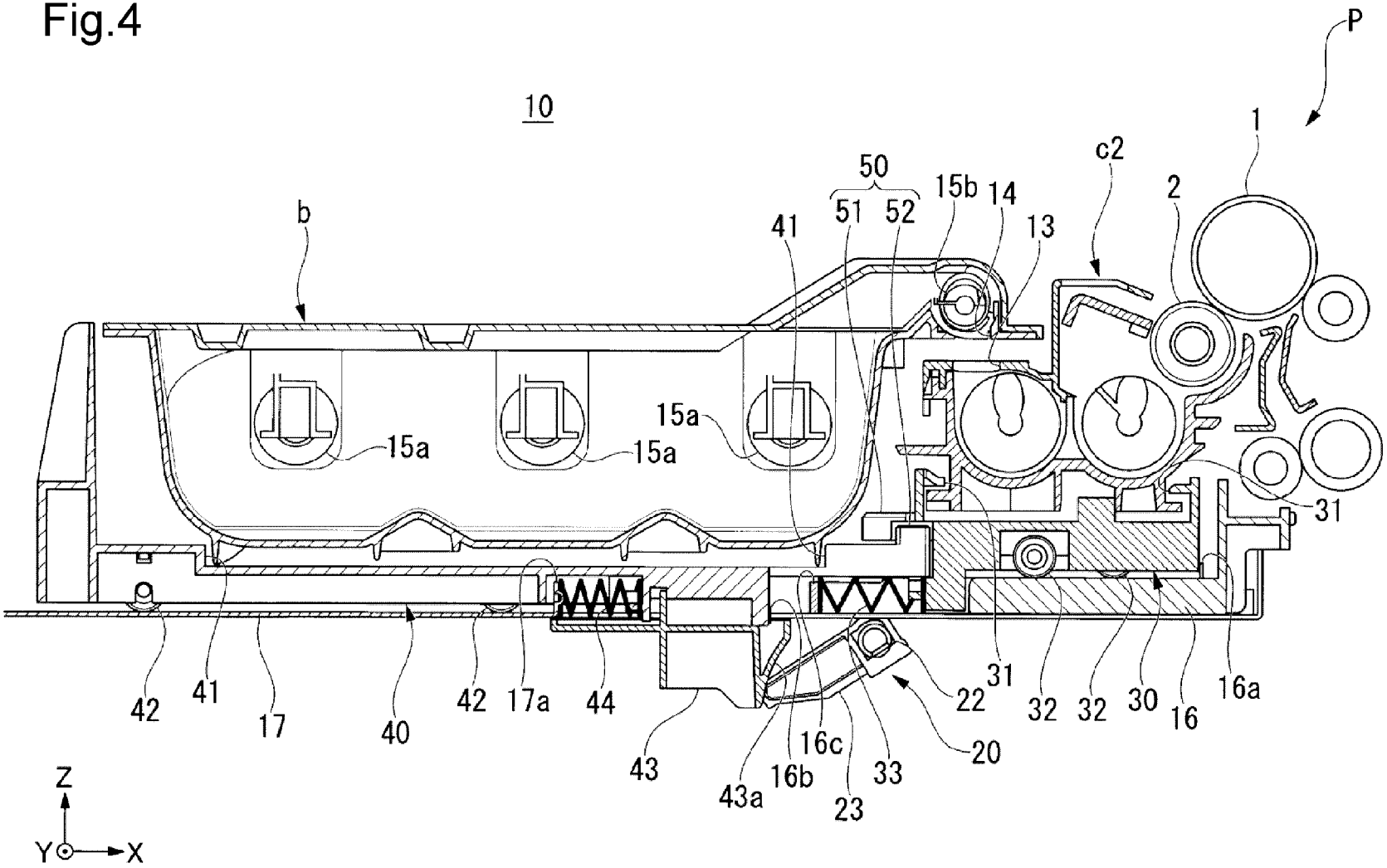
FIG. 4 is a structural view showing the arrangement of units when an operating device is located at a first position (escape position) in the one embodiment of the present disclosure.
Figure 5:
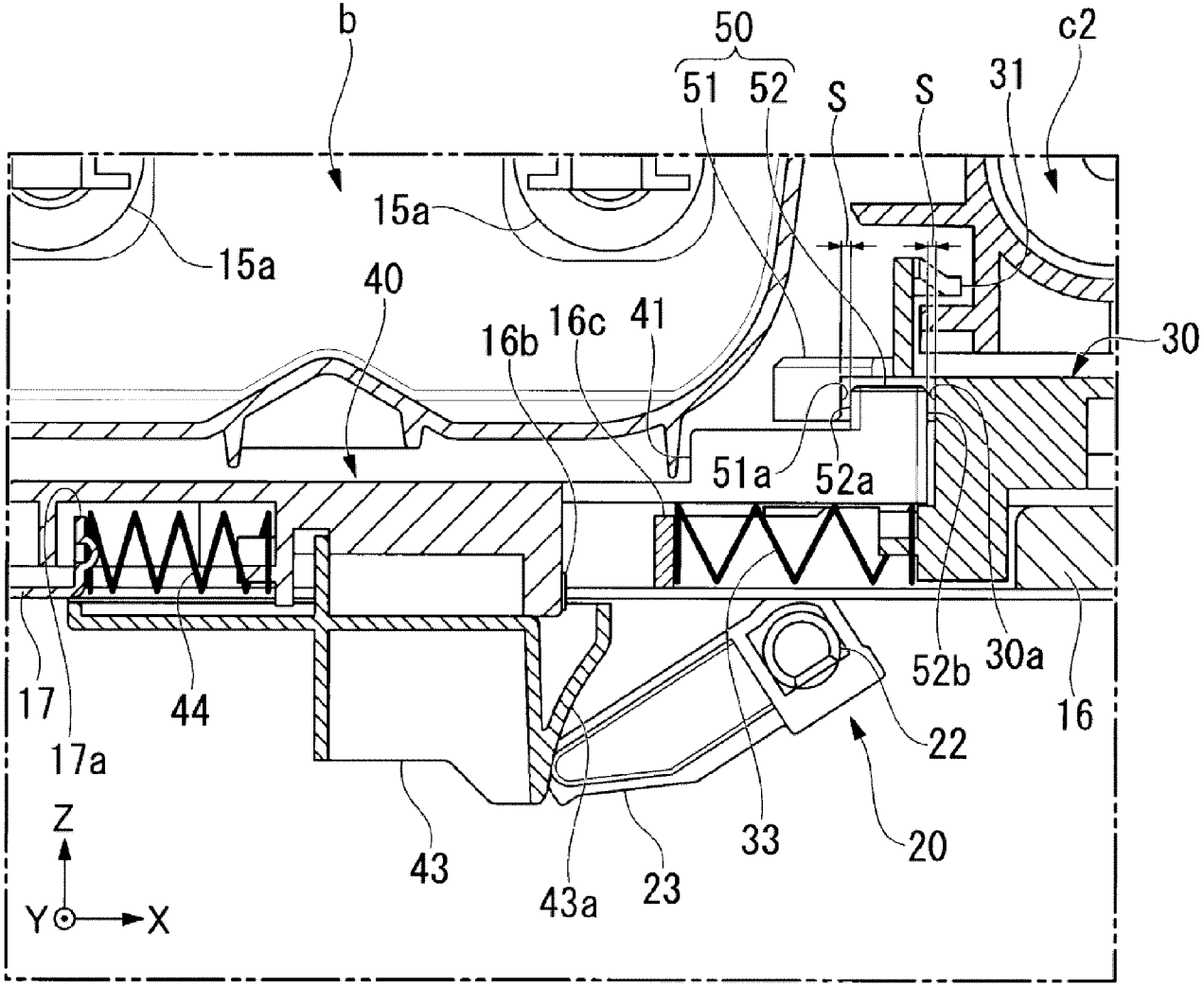
FIG. 5 is an enlarged view showing a relevant portion in FIG. 4.
Figure 6:
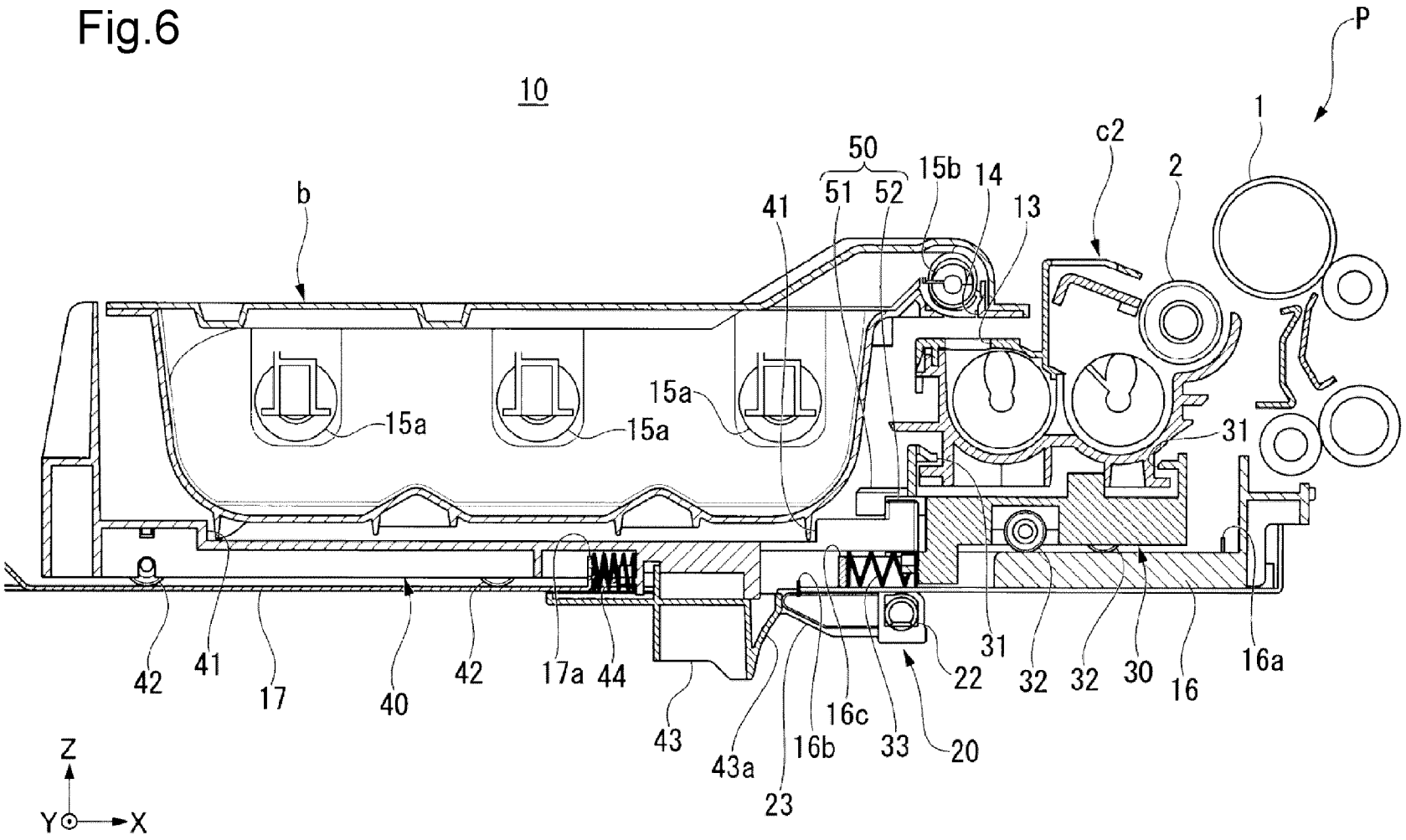
FIG. 6 is a structural view showing the arrangement of the units when the operating device is located at a second position (drag position) in the one embodiment of the present disclosure.
Figure 7:
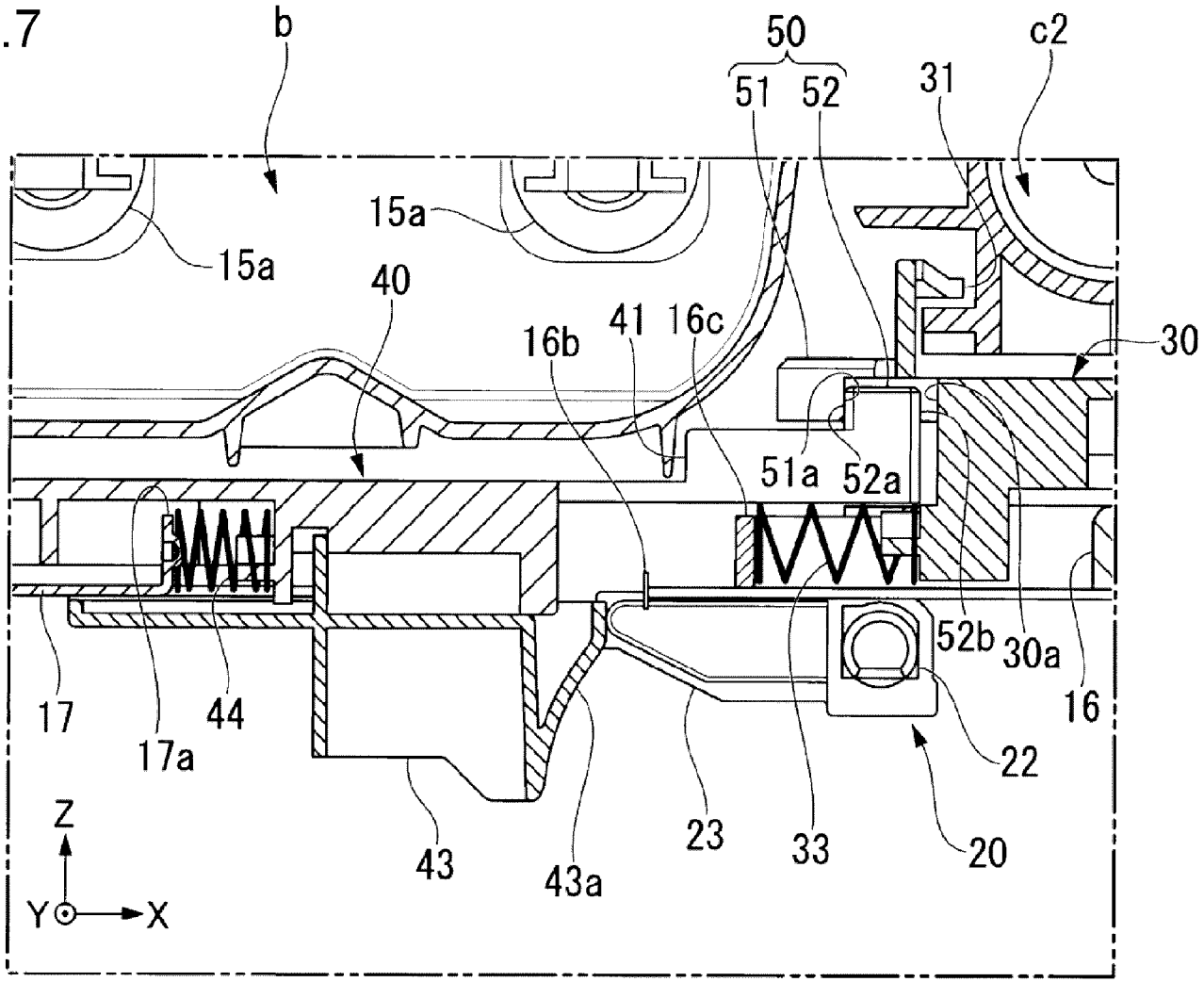
FIG. 7 is an enlarged view showing a relevant portion in FIG. 6.
Figure 8:
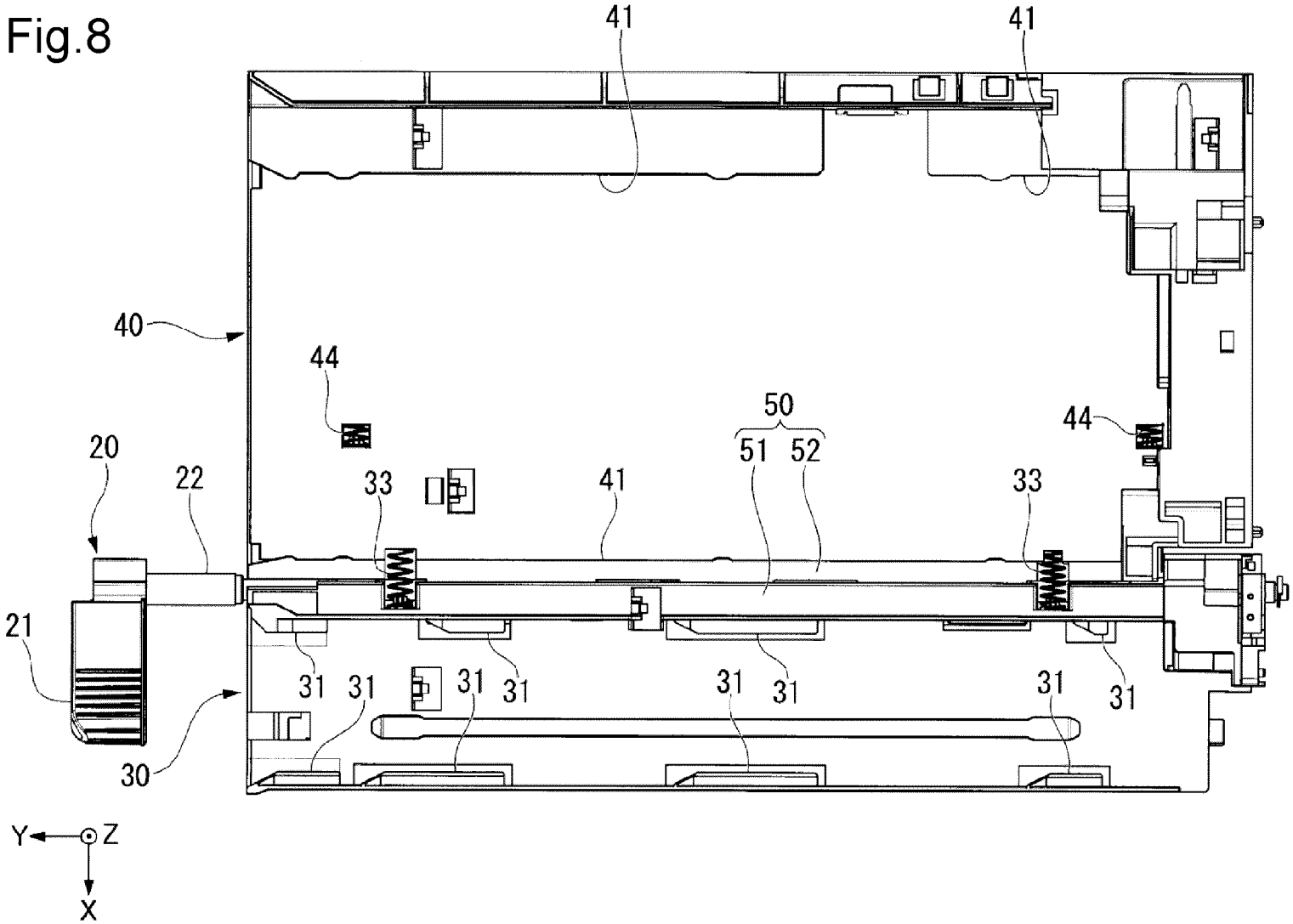
FIG. 8 is a plan view showing a first movable unit and a second movable unit in the one embodiment of the present disclosure.
Figure 9:
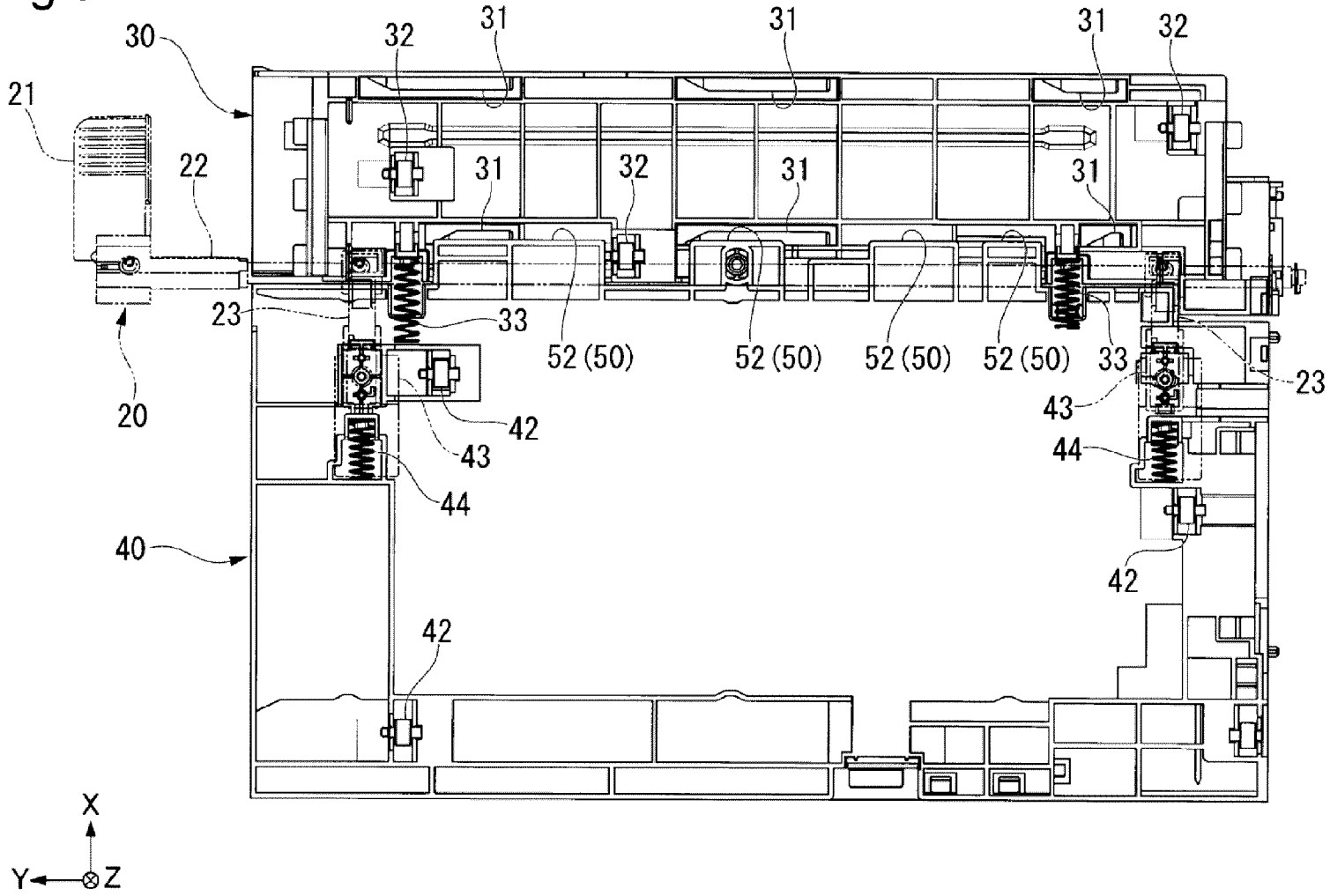
FIG. 9 is a bottom view showing the first movable unit and the second movable unit in the one embodiment of the present disclosure.

FIG. 4 is a structural view showing the arrangement of the units when the operating device 20 is located at a first position (escape position) in the one embodiment of the present disclosure. FIG. 5 is an enlarged view showing a relevant portion in FIG. 4. FIG. 6 is a structural view showing the arrangement of the units when the operating device 20 is located at a second position (drag position) in the one embodiment of the present disclosure. FIG. 7 is an enlarged view showing a relevant portion in FIG. 6. FIG. 8 is a plan view showing a first movable unit 30 and a second movable unit 40 in the one embodiment of the present disclosure. FIG. 9 is a bottom view showing the first movable unit 30 and the second movable unit 40 in the one embodiment of the present disclosure.

As shown in FIG. 4, the developing roller 2 of the developing unit c2 configured to develop a toner image is disposed facing the photosensitive drum 1 in the radial direction thereof. The developing unit c2 includes unshown gap rollers and is configured to maintain a constant distance between the developing roller 2 and the photosensitive drum 1 by pressing the gap rollers against both ends of the photosensitive drum 1. Furthermore, the developing unit c2 has an opening 13 through which toner is supplied from the toner container b into the developing unit c2. The opening 13 is formed at the opposite side of the developing unit c2 to the developing roller 2 (at the −x side of the developing unit c2) and is open upward.

The toner container b is disposed on the back side (the −x side) of the developing unit c2. The toner container b has an opening 14 through which it supplies toner to the developing unit c2. The opening 14 is open downward to face the opening 13 in the developing unit c2 in the z-axis direction. The toner container b contains a plurality of agitating members 15*a* and a screw 15*b* which are operable to agitate and convey toner contained inside the toner container b. The agitating members 15*a* and the screw 15*b* are connected to unshown drive sources and configured to be driven into rotation around their axes by the drive sources. The toner contained in the toner container b is transported to the opening 14 by the driving of the agitating members 15*a* and the screw 15 and then supplied to the developing unit c2.

The developing unit c2 is mounted on a first movable unit 30. The first movable unit 30 includes a rail 31 carrying the developing unit c2 to allow the developing unit c2 to be pulled out in the y-axis direction. The first movable unit 30 is configured to be movable between a close position where the developing roller 2 is located close to the photosensitive drum 1 as shown in FIG. 4 and a distant position where the developing roller 2 is located away from the photosensitive drum 1 as shown in FIG. 6. While the first movable unit 30 is located at the close position, the gap between the developing roller 2 and the photosensitive drum 1 is maintained at a predefined distance.

Specifically, a plurality of casters 32 are provided on the underside of the first movable unit 30 (see FIG. 9). The casters 32 are rotatable around their axes extending in the y-axis direction. The casters 32, as shown in FIG. 4, are operable to roll on a first fixed frame 16 fixed to the apparatus body 10. The first fixed frame 16 is provided with a first restricting part 16*a* operable to restrict further movement of the first movable unit 30 toward the photosensitive drum 1 (in the +x direction) beyond the close position. The first fixed frame 16 is further provided with a second restricting part (restricting part) 16*b* operable to restrict further movement of the after-mentioned second movable unit 40 toward the photosensitive drum 1 (in the +x direction) beyond the after-mentioned standby position.

The first movable unit 30 is urged by a plurality of pressure springs (a first urging part) 33. The plurality of pressure springs 33 are spaced apart from each other in the y-axis direction and configured to urge the first movable unit 30 (see FIGS. 8 and 9). As shown in FIG. 4, one ends of the pressure springs 33 bear against the back side (−x side) of the first movable unit 30 and the other ends thereof bear against the front sides (+x sides) of respective spring abutments 16*c* provided on the first fixed frame 16. When in a state shown in FIG. 4, the pressure springs 33 store their force, press the first movable unit 30 against the first restricting part 16*a*, and press the unshown gap rollers of the developing unit c2 mounted on the first movable unit 30 against the photosensitive drum 1.

The toner container b is mounted on a second movable unit 40. The second movable unit 40 includes a rail 41 guiding the toner container b to allow the toner container b to be pulled out in the y-axis direction. The second movable unit 40, as shown in FIG. 6, is configured to drag the first movable unit 30 from the close position to the distant position. While the second movable unit 40 is located at a standby position for the drag as shown in FIG. 4, a clearance S is formed between the first and second movable units 30, 40 to avoid physical contact between the first and second movable units 30, 40 (see FIG. 5).

Specifically, a plurality of casters 42 are provided on the underside of the second movable unit 40 (see FIG. 9). The casters 42 are rotatable around their axes extending in the y-axis direction. The casters 42, as shown in FIG. 4, are operable to roll on a second fixed frame 17 fixed to the apparatus body 10. The second fixed frame 17 is disposed to the left (the −x side) of the first fixed frame 16. A space is formed between the first fixed frame 16 and the second fixed frame 17. Abutment portions 43 of the second movable unit 40 extend through the space between the first fixed frame 16 and the second fixed frame 17 downward of the undersides of them (toward the −z side) and are configured to allow the second movable unit 40 to abut on the operating device 20.

The second movable unit 40 is urged by a plurality of pressure springs (a second urging part) 44. The plurality of pressure springs 44 are spaced apart from each other in the y-axis direction and configured to urge the second movable unit 40 (see FIGS. 8 and 9). As shown in FIG. 4, one ends of the pressure springs 44 bear against the left sides (−x sides) of the abutment portions 43 of the second movable unit 40 and the other ends thereof bear against the right sides (+x sides) of respective spring abutments 17*a* provided on the second fixed frame 17. When in a state shown in FIG. 4, the pressure springs 44 store their force and press the second movable unit 40 against the second restricting part 16*b* to position the second movable unit 40 at the standby position.

The operating device 20 is configured to be movable between a second position (drag position, see FIG. 6) where it moves the second movable unit 40 against the urge of the pressure springs 33, 44 to allow the second movable unit 40 to drag the first movable unit 30 and a first position (escape position, see FIG. 4) where it escapes from the second position. The operating device 20 includes: an operating lever 21 provided at a location where the worker can grasp it; a rotary shaft 22 connected to the operating lever 21; and a pair of cam members 23 provided on the rotary shaft 22 and capable of moving the second movable unit 40 according to changes in position around the axis of the rotary shaft 22.

The rotary shaft 22 is mounted in an unshown bearing provided at the apparatus body 10 and held therein rotatably around an axis extending in the y-axis direction. The operating lever 21 is connected to an end of the rotary shaft 22 on the +y side thereof (see FIG. 8). The operating lever 21, as shown in FIG. 3, is configured to be exposed at the near side (+y side) of the apparatus body 10 when the cover 11 is opened. The first position (see FIG. 4) of the operating device 20 is a position when the operating lever 21 takes a diagonal position of approximately 45 degrees as shown in FIG. 3. The second position (see FIG. 6) of the operating device 20 is a position when the operating lever 21 is lowered from the diagonal position to a substantially horizontal position.

Each cam member 23 has an approximately claw shape rounded at a distal end thereof and is fixed at a predetermined angle to the rotary shaft 22. The distal ends of the cam members 23 are configured to be engageable against the associated abutment portions 43 of the second movable unit 40. Each abutment portion 43 has an abutment surface 43*a* having a predetermined curvature not concentric with the rotary shaft 22 but centered at a point below the rotary shaft 22. Therefore, when the cam members 23 move with the rotation of the rotary shaft 22, the positions of engagement of the distal ends of the cam members 23 against the abutment surfaces 43*a* change in the x-axis direction (see FIGS. 4 and 6).

As shown in FIG. 9, the cam members 23 are provided, on the rotary shaft 22, in a pair spaced apart from each other in the y-axis direction. The cam members 23 are disposed at positions near to both widthwise ends of the second movable unit 40. The abutment portions 43 of the second movable unit 40 are formed in association with the respective cam members 23. Therefore, the second movable unit 40 can stably move in the x-axis direction in contact at two points with the cam members 23.

As shown in FIG. 4, an interconnecting mechanism 50 is provided between the first movable unit 30 and the second movable unit 40. The interconnecting mechanism 50 is configured to, during drag of the second movable unit 40, interconnect the first movable unit 30 and the second movable unit 40 and, while the second movable unit 40 is at the standby position, disconnect the first movable unit 30 from the second movable unit 40 (see FIGS. 5 and 7). The interconnecting mechanism 50 includes a first hook portion 51 and a plurality of second hook portions 52.

The first hook portion 51 is provided on the first movable unit 30. The first hook portion 51 is provided on the left side (−x side) of the first movable unit 30 to extend in the width direction (y-axis direction) of the first movable unit 30 (see FIG. 8). The first hook portion 51 has an L-shape when viewed from the front (+y side) as shown in FIG. 5. The first hook portion 51 has an engagement surface 51*a* engageable with the second hook portions 52 in the direction of the drag (x-axis direction). The engagement surface 51*a* is disposed facing to the right (+x side).

The second hook portions 52 are provided on the second movable unit 40. The second hook portions 52 are provided, on the right side (+x side) of the second movable unit 40, at intervals in the width direction (y) of the second movable unit 40 (see FIG. 9). The second hook portions 52 have an L-shape when viewed from the front (+y side) as shown in FIG. 5. Each second hook portion 52 has an engagement surface 52*a* engageable with the first hook portion 51 in the direction of the drag (x-axis direction). The engagement surfaces 52*a* are disposed facing to the left (−x side).

In the interconnecting mechanism 50 configured as described above, the first and second hook portions 51, 52 are faced in directions of movement of the first and second movable units 30, 40 away from each other. Therefore, when the second movable unit 40 relatively moves toward the −x side, the engagement surfaces 51*a*, 52*a* engage together, so that the first and second movable units 30, 40 are interconnected (see FIG. 7). On the other hand, the first and second hook portions 51, 52 do not engage in directions of movement of the first and second movable units 30, 40 toward each other. Therefore, when the second movable unit 40 relatively moves toward the +x side, the engagement surfaces 51*a*, 52*a* are disengaged from each other, so that the first and second movable units 30, 40 are disconnected from each other (see FIG. 5).

As shown in FIG. 5, the first and second movable units 30, 40 are configured so that while the second movable unit 40 is located at the standby position for the drag, a clearance S is formed between the first and second movable units 30, 40 to avoid physical contact between them. The first and second movable units 30, 40 can make and break contact with each other only in the x-axis direction. The clearance S is formed when the first movable unit 30 is at a pressing position and the second movable unit 40 is at the standby position. Specifically, the clearance S is formed between the engagement surface 51*a* of the first hook portion 51 and the engagement surface 52*a* of each second hook portion 52 and between the back surface 30*a* of the first movable unit 30 and the front end surface 52*b* of each second hook portion 52. The clearance S is set at a value greater than the amplitude of vibration of the second movable unit 40 associated with the driving of the toner container b, for example, at 1 mm.

A description will be next given of a separating work for separating the developing unit c2 from the photosensitive drum 1 in the copier P configured as described above.

In taking the developing unit c2 and/or the drum unit c3 out of the apparatus body 10, the worker first opens the cover 11 provided on the near side of the apparatus body 10 as shown in FIG. 2. When the cover 11 is opened, the operating lever 21 of the operating device 20 is exposed at the near side of the apparatus body 10 as shown in FIG. 3.

Next, the worker changes the operating device 20 from the first position to the second position. Specifically, the worker grasps the operating lever 21 and lowers it from the diagonal position of approximately 45 degrees to the substantially horizontal position. When the operating lever 21 is lowered and the operating device 20 thereby changes from the first position to the second position, the first movable unit 30 moves from the close position to the distant position, so that the positioning of the developing roller 2 relative to and the pressing thereof against the photosensitive drum 1 are removed (see FIG. 6).

More specifically, when the operating lever 21 is lowered, the rotary shaft 22 connected to the operating lever 21 rotates. When the rotary shaft 22 rotates, the distal ends of the cam members 23 rock to push the abutment surfaces 43*a*, so that the second movable unit 40 moves toward the −x side against the urge of the pressure springs 44. When the second movable unit 40 moves toward the −x side, the first and second hook portions 51, 52 engage with each other as shown in FIG. 7, so that the first and second movable units 30, 40 are interconnected.

When the operating lever 21 is further lowered, the second movable unit 40 drags the connected first movable unit 30 from the close position to the distant position against the urge of the pressure springs 33, 44 (see FIG. 6). The second movable unit 40 carries the toner container b and the first movable unit 30 carries the developing unit c2. Therefore, when the second movable unit 40 drags the first movable unit 30, the developing unit c2 and the toner container b can be moved together toward the −x side. Hence, the worker can secure a space at the destination of movement of the developing unit c2 without removing the toner container b and can easily do the separating work for the developing unit c2 with a single operation of the operating device 20.

A description will be next given of the work for bringing back the developing unit c2 in the copier P configured as described above.

In installing a replaced developing unit c2 or drum unit c3 back into the apparatus body 10, the worker changes the operating device 20 from the second position to the first position. Specifically, the worker grasps the operating lever 21 and raises it from the substantially horizontal position to the diagonal position of approximately 45 degrees. When the operating lever 21 is raised and the operating device 20 thereby changes from the second position to first second position, the first movable unit 30 moves from the distant position to the close position, so that the developing roller 2 is pressed against and positioned relative to the photosensitive drum 1.

More specifically, when the operating lever 21 is raised, the rotary shaft 22 connected to the operating lever 21 rotates. When the rotary shaft 22 rotates, the distal ends of the cam members 23 turn to avoid pressing against the abutment surfaces 43*a*, so that the second movable unit 40 moves toward the +x side by the urge of the pressure springs 44. When the second movable unit 40 moves toward the +x side, the first and second hook portions 51, 52 are disengaged from each other as shown in FIG. 5, so that the first and second movable units 30, 40 are disconnected from each other.

As a result of the disconnection, an urging force of the pressure springs 33 acts on the first movable unit 30 and an urging force of the pressure springs 44 acts on the second movable unit 40. Since in this manner the first and second movable units 30, 40 are moved by the action of different urging forces, this prevents the first and second movable units 30, 40 from returning together back to their original positions. In other words, as shown in FIG. 4, the first movable unit 30 can be located at the close position and the second movable unit 40 can be located at the standby position, so that both the units can be physically separated from each other.

The first movable unit 30 is pressed against the first restricting part 16*a* by the pressure springs 33 and the unshown gap rollers of the developing unit c2 are pressed against the photosensitive drum 1, so that the first movable unit 30 is positioned at the close position shown in FIG. 4. The second movable unit 40 is pressed against the second restricting part 16*b* by the pressure springs 44 and thus positioned at the standby position shown in FIG. 4. The second restricting part 16*b* prevents the second movable unit 40 from overrunning and thus avoids collision between each of the front end surfaces (right side surfaces) 52*b* of the second hook portions 52 on the second movable unit 40 and the back surface (left side surface) 30*a* of the first movable unit 30 to appropriately provide the clearance S (see FIG. 5).

As shown in FIG. 5, while the second movable unit 40 is located at the standby position for the drag, the clearance S is formed between the second movable unit 40 and the first movable unit 30. As seen from this, while the second movable unit 40 does not perform the dragging, the first movable unit 30 located at the close position is physically separated from the second movable unit 40 located at the standby position. The clearance S is formed to have a certain dimension and serves to avoid that the effect of torque variations due to the driving of the agitating members 15*a* and the screw 15*b* and increase and decrease in remaining toner amount in the toner container b acts on the developing unit c2 through the first movable unit 30. Therefore, the developing roller 2 can avoid the above effect derived from the toner container b to keep a constant distance from the photosensitive drum 1 *b* and can be thereby prevented from having any adverse effect on the image quality.

Generally, in pulling the developing unit out of the apparatus body, it is necessary to separate the developing unit from the photosensitive drum to locate the developing roller away from the photosensitive drum. To separate the developing unit from the photosensitive drum, it is necessary to create a space at the destination of movement of the developing unit. In most separating mechanisms, the space at the destination of movement of the developing unit is secured by removing the toner container disposed behind the developing unit and configured to supply toner to the developing unit. In the case of such a configuration, however, it takes a lot of time and effort to do the separating work.

Meanwhile, there is known a developer supporting device configured to move a toner container and a developer on a common carriage. The toner container is generally provided with a screw operable to agitate and convey toner. The carriage is affected by torque variations due to the driving of the screw and increase/decrease in remaining toner amount. Thus, the force to urge the carriage with the urging device varies, so that the force to press the gap rollers against the photosensitive drum also varies. Therefore, the distance between the developing roller and the photosensitive drum may vary, resulting in an adverse effect on the image quality.

Unlike the above known technique, the image forming apparatus according to the one embodiment of the present disclosure includes: a developing unit c2 including a developing roller 2 operable to develop a toner image on a peripheral surface of a photosensitive drum 1; a toner container b configured to supply toner to the developing unit c2; a first movable unit 30 carrying the developing unit c2 and movable between a close position where the developing roller 2 is located close to the photosensitive drum 1 and a distant position where the developing roller 2 is located away from the photosensitive drum 1; and a second movable unit 40 carrying the toner container b and configured to drag the first movable unit 30 from the close position to the distant position, wherein while the second movable unit 40 is located at a standby position for the drag, a clearance S is formed between the first and second movable units 30, 40 to avoid physical contact between the first and second movable units 30, 40.

With the use of this configuration, in the image forming apparatus according to the one embodiment of the present disclosure, the developing unit c2 and the toner container b are mounted on different movable units and in separating the developing unit c2 from the photosensitive drum 1, the second movable unit 40 drags the first movable unit 30 to move the developing unit c2 to the distant position. Since in this manner the developing unit c2 and the toner container b are moved together in separating the developing unit c2 from the photosensitive drum 1, the time and effort taken for the separating work can be reduced. Furthermore, while the second movable unit 40 is located at the standby position for the drag, the clearance S is formed between the second movable unit 40 and the first movable unit 30. As seen from this, while the second movable unit 40 does not perform the dragging, the first movable unit 30 located at the close position is physically separated from the second movable unit 40 located at the standby position. Therefore, the developing roller 2 can avoid the previously-described effect derived from the toner container b to keep a constant distance from the photosensitive drum 1 and can be thereby prevented from having any adverse effect on the image quality.

The image forming apparatus according to the one embodiment of the present disclosure further includes an interconnecting mechanism 50 configured to, during drag of the second movable unit 40, interconnect the first movable unit 30 and the second movable unit 40 and, while the second movable unit 40 is at the standby position, disconnect the first movable unit 30 from the second movable unit 40.

With the use of this configuration, in the image forming apparatus according to the one embodiment of the present disclosure, during drag of the second movable unit 40, the first and second movable units 30, 40 are interconnected by the interconnecting mechanism 50, so that the developing unit c2 and the toner container b can be moved together. On the other hand, while the second movable unit 40 is at the standby position and does not perform the dragging, the first and second movable units 30, 40 are disconnected from each other. Therefore, the clearance S can be formed between both the units and the developing roller 2 can avoid the above effect derived from the toner container b to keep a constant distance from the photosensitive drum 1.

Furthermore, in the image forming apparatus according to the one embodiment of the present disclosure, the interconnecting mechanism 50 includes a first hook portion 51 provided on the first movable unit 30; and second hook portions 52 provided on the second movable unit 40 and engageable with the first hook portion 51 in the direction of the drag.

With the use of this configuration, in the image forming apparatus according to the one embodiment of the present disclosure, when the first hook portion 51 provided on the first movable unit 30 and the second hook portions 52 provided on the second movable unit 40 are engaged with each other in the direction of the drag, both the movable units 30, 40 are interconnected. On the other hand, when the first hook portion 51 provided on the first movable unit 30 and the second hook portions 52 provided on the second movable unit 40 are disengaged from each other in the direction of the drag, both the movable units 30, 40 are disconnected from each other.

Moreover, the image forming apparatus according to the one embodiment of the present disclosure further includes: pressure springs 33 (a first urging part) configured to urge the first movable unit 30 toward being located at the close position; pressure springs 44 (a second urging part) configured to urge the second movable unit 40 toward being located at the standby position; and an operating device 20 movable between a drag position where the operating device 20 moves the second movable unit 40 against the urge of the pressure springs 33, 44 to allow the second movable unit 40 to perform the dragging and an escape position where the operating device 20 escapes from the drag position.

With the use of this configuration, in the image forming apparatus according to the one embodiment of the present disclosure, the pressure springs 33 and the pressure springs 44 are provided and the first and second movable units 30, 40 are moved against the respective urging forces of their respective associated pressure springs 33, 44. Therefore, in bringing the first and second movable units 30, 40 back to their original positions, they are moved by the different urging forces. Thus, the first and second movable units 30, 40 can be prevented from returning together back to their original positions, the first movable unit 30 can be located again at the close position, the second movable unit 40 can be located again at the standby position, and the clearance S can be formed again between both the units.

Furthermore, the image forming apparatus according to the one embodiment of the present disclosure further includes a second restricting part 16*b* (the restricting part) operable to restrict further movement of the second movable unit 40 beyond the standby position due to the urge of the pressure springs 44 (the second urging part).

With the use of this configuration, in the image forming apparatus according to the one embodiment of the present disclosure, the second movable unit 40 can be prevented from overrunning and can appropriately form a clearance S with the first movable unit 30 to avoid physical contact between them.

Moreover, in the image forming apparatus according to the one embodiment of the present disclosure, the operating device 20 includes: an operating lever 21 provided at a location where the worker can grasp it; a rotary shaft 22 connected to the operating lever 21; and a pair of cam members 23 provided on the rotary shaft 22, configured to be engageable at distal ends thereof against the second movable unit 40, and capable of moving the second movable unit 40 according to changes in position around the rotary shaft 22.

With the use of this configuration, in the image forming apparatus according to the one embodiment of the present disclosure, the worker can separate the developing unit c2 from or bring it back close to the photosensitive drum 1 in conjunction with a simple operation of the operating lever 21, resulting in reduced time and effort taken for the worker to do the work.

Although a preferred embodiment of the present disclosure has been thus far described with reference to the drawings, the present disclosure is not limited to the above embodiment. The shapes, combination, and so on of elements shown in the above embodiment are illustrative only and various modifications can be made to them based on design and other needs without departing from the spirit and scope of the present disclosure.

Figure 10:
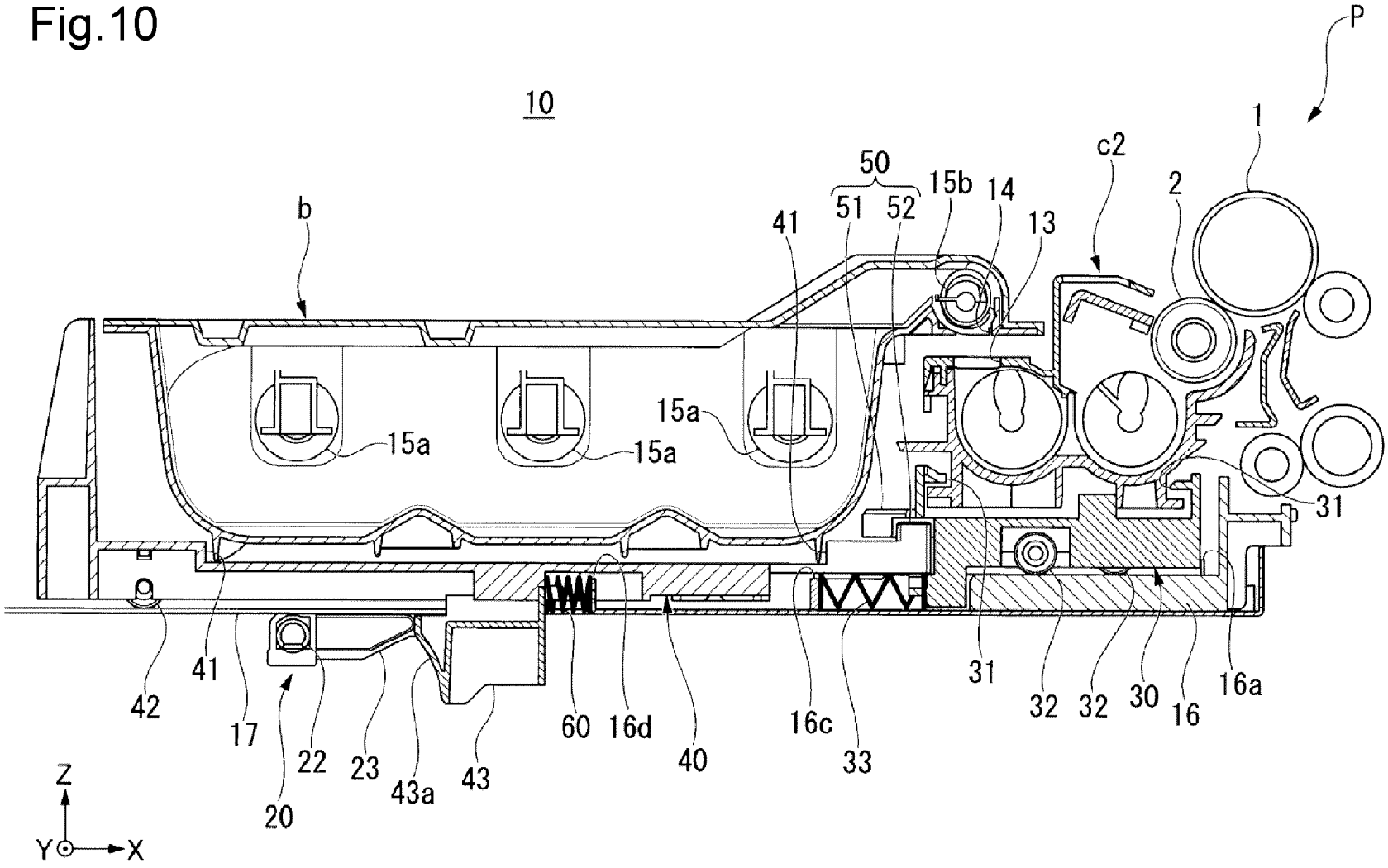
FIG. 10 is a structural view showing the arrangement of units when an operating device is located at a first position in another embodiment of the present disclosure.
Figure 11:
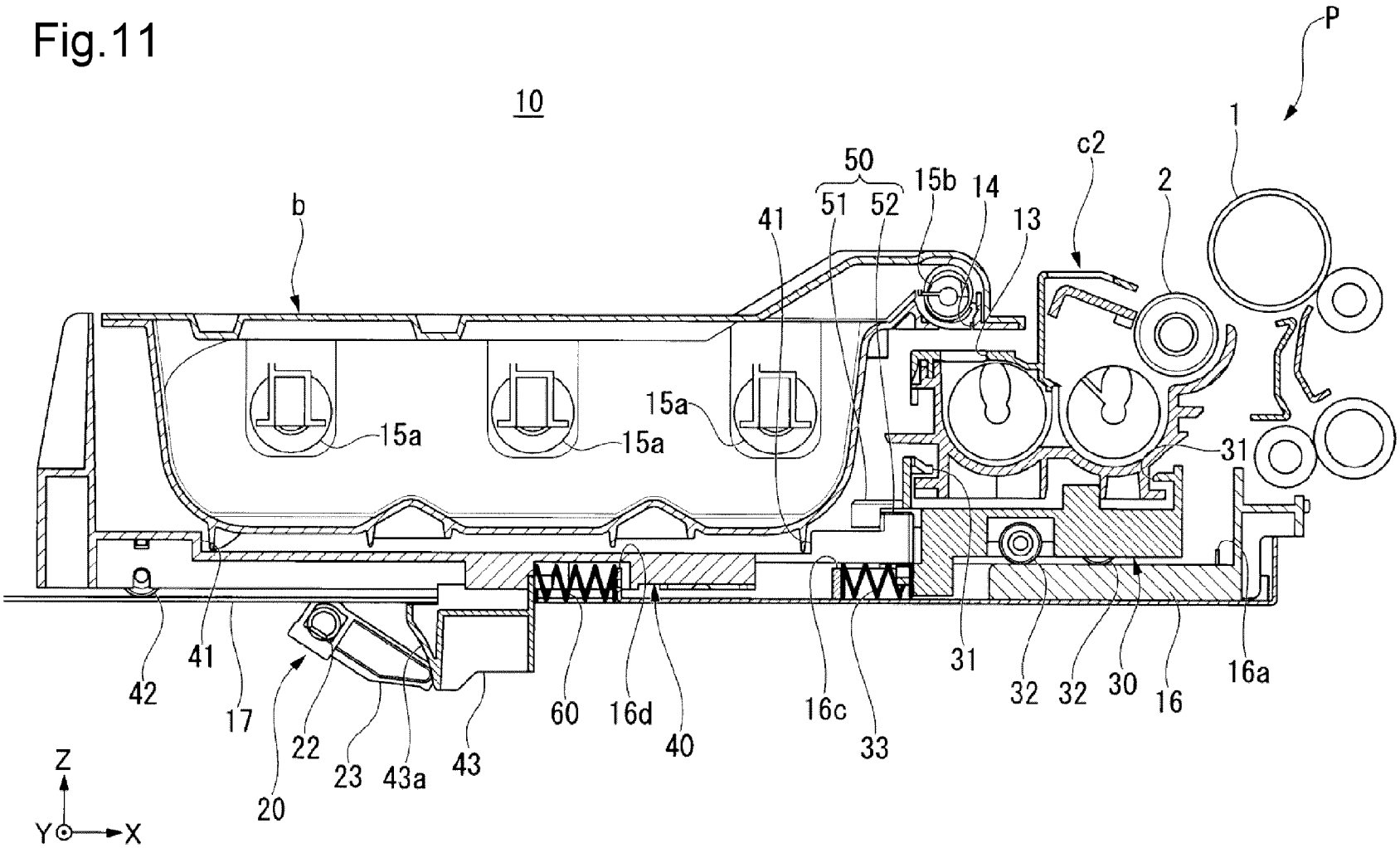
FIG. 11 is a structural view showing the arrangement of the units when the operating device is located at a second position in the other embodiment of the present disclosure.

For example, the configuration shown in FIGS. 10 and 11 may be adopted. Throughout the following description, the same or similar elements as those in the above embodiment will be designated by the same references and further explanation thereof will be accordingly omitted or simplified.

FIG. 10 is a structural view showing the arrangement of units when an operating device 20 is located at a first position in another embodiment of the present disclosure. FIG. 11 is a structural view showing the arrangement of the units when the operating device 20 is located at a second position in the other embodiment of the present disclosure.

The second movable unit 40 is urged by a plurality of pressure springs 60. As shown in FIG. 10, one ends of the pressure springs 60 bear against the front side (+x side) of abutment portions 43 of the second movable unit 40 and the other ends thereof bear against the left sides (−x sides) of respective spring abutments 16*d* provided on the first fixed frame 16. When in a state shown in FIG. 10, the pressure springs 60 are compressed and press the second movable unit 40 against the cam members 23 to position the second movable unit 40 at the standby position. The spring force of the pressure springs 60 is set to be sufficiently larger than that of the pressure springs 33.

The operating device 20 is configured to be movable between a first position (see FIG. 10) where it positions the second movable unit 40 at the standby position and a second position (see FIG. 11) where it escapes from the first position. When the operating device 20 moves to the second position, the restriction due to pressing of the pressure springs 60 is removed. Since the spring force of the pressure springs 60 is larger than that of the pressure springs 33, the second movable unit 40 moves toward the −x side. When the second movable unit 40 moves toward the −x side, the first and second hook portions 51, 52 engage with each other as shown in FIG. 7. Thus, the first and second movable units 30, 40 are interconnected, so that the second movable unit 40 drags the first movable unit 30 from the close position to the distant position.

With the other embodiment configured as described above, like the first-mentioned embodiment, a copier P can be obtained in which the time and effort taken for the separating work for the developing unit c2 are little and the developing unit c2 is prevented from having any adverse effect on the image quality. Furthermore, with the other embodiment configured as described above, part of the spring force of the pressure springs 60 is offset by the spring force of the pressure springs 33 when the restriction due to pressing of the pressure springs 60 is removed. Therefore, the force necessary for the worker to operate the operating device 20 can be reduced.

Although in the above embodiments a copier has been described as an example of the image forming apparatus according to the present disclosure, the present disclosure is applicable to other types of image forming apparatuses, including a printer and a facsimile machine.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus comprising:

a developing unit including a developing roller operable to develop a toner image on a peripheral surface of a photosensitive drum;

a toner container configured to supply toner to the developing unit;

a first movable unit carrying the developing unit and movable between a close position where the developing roller is located close to the photosensitive drum and a distant position where the developing roller is located away from the photosensitive drum; and a second movable unit carrying the toner container and configured to drag the first movable unit from the close position to the distant position, wherein while the second movable unit is located at a standby position for the drag, a clearance is formed between the first and second movable units to avoid physical contact between the first and second movable units.

2. The image forming apparatus according to claim 1, further comprising an interconnecting mechanism configured to, during the drag of the second movable unit, interconnect the first movable unit and the second movable unit and, while the second movable unit is at the standby position, disconnect the first movable unit from the second movable unit.

3. The image forming apparatus according to claim 2, wherein the interconnecting mechanism comprises:

a first hook portion provided on the first movable unit; and a second hook portion provided on the second movable unit and engageable with the first hook portion in a direction of the drag.

4. The image forming apparatus according to claim 1, further comprising a first urging part configured to urge the first movable unit toward being located at the close position;

a second urging part configured to urge the second movable unit toward being located at the standby position; and an operating device movable between a drag position where the operating device moves the second movable unit against the urge of the first and second urging parts to allow the second movable unit to drag the first movable unit and an escape position where the operating device escapes from the drag position.

5. The image forming apparatus according to claim 4, further comprising a restricting part operable to restrict further movement of the second movable unit beyond the standby position due to the urge of the second urging part.

6. The image forming apparatus according to claim 4, wherein the operating device comprises:

an operating lever provided at a location where a worker can grasp the operating lever;

a rotary shaft connected to the operating lever; and a cam member provided on the rotary shaft, configured to be engageable at a distal end thereof against the second movable unit, and capable of moving the second movable unit according to changes in position around the rotary shaft.

* * * * *